United States Patent [19]

Tatara

[11] Patent Number: 4,823,437

[45] Date of Patent: Apr. 25, 1989

[54] SPRING LOADED HINGE

[76] Inventor: Stanley R. Tatara, 4911 Schutt Rd., Akron, N.Y. 14001

[21] Appl. No.: 170,835

[22] Filed: Mar. 21, 1988

[51] Int. Cl.[4] ..... E05F 1/08

[52] U.S. Cl. ..... 16/300; 16/301; 16/308

[58] Field of Search ..... 16/308, 300, 301, 386

[56] References Cited

U.S. PATENT DOCUMENTS

| | | | |
|---|---|---|---|
| 2,934,784 | 5/1960 | Price, Jr. et al. | 16/308 |
| 3,787,923 | 1/1974 | Peterson | 16/308 |
| 3,825,973 | 7/1974 | Gwozdz | 16/300 |

FOREIGN PATENT DOCUMENTS

| | | | |
|---|---|---|---|
| 2556059 | 7/1976 | Fed. Rep. of Germany | 16/308 |
| 1282 | of 1863 | United Kingdom | 16/300 |

*Primary Examiner*—Nicholas P. Godici
*Assistant Examiner*—Carmine Cuda
*Attorney, Agent, or Firm*—Harlan E. Hummer

[57] ABSTRACT

A continuous, elongated hinge is described as having a hinge pin which is comprised of two solid pivot pins which are oppositely disposed and axially spaced from each other. The more closely spaced distal ends of the pivot pins have a pair of parti-cylindrical lugs with a slot between them. A flat spring extends between the pivot pins and is received in the slots between the lugs. A hollow sleeve extends between the pivot pins and surrounds the spring and lugs to provide a smooth, continuous outer cylindrical surface for the hinge pin.

5 Claims, 1 Drawing Sheet

SPRING LOADED HINGE

BACKGROUND OF INVENTION

The invention relates to hinges, especially piano-type continuous hinges which are used on doors of movable partition walls. Such hinges are normally spring loaded with a highly visible coil spring that is positioned exteriorly of the hinge to coact between the part of the hinge which is secured to the door, i.e. the door leaf, and the part of the hinge which is secured to the door frame, i.e. the frame leaf.

The invention is designed to provide a simple, self-contained piano hinge which does not have an unsightly coil spring as heretofore used.

Briefly stated, the invention is in a continuous elongated hinge which has two leaves that are pivotally connected by a hinge pin which is formed of two axially aligned solid pivot pins which are separated by a flat spring which is secured to adjacent opposing ends of the pivot pins. Means are provided for securing one of the two pivot pins to one of the leaves and the other of the pivot pins to the other leaf of the hinge, and other means are used to extend the cylindrical surfaces of the pivot pins between the pins.

DESCRIPTION OF DRAWING

The following description of the invention will be better understood by having reference to the following drawing, wherein.

DETAILED DESCRIPTION OF DRAWING

Figure 1:
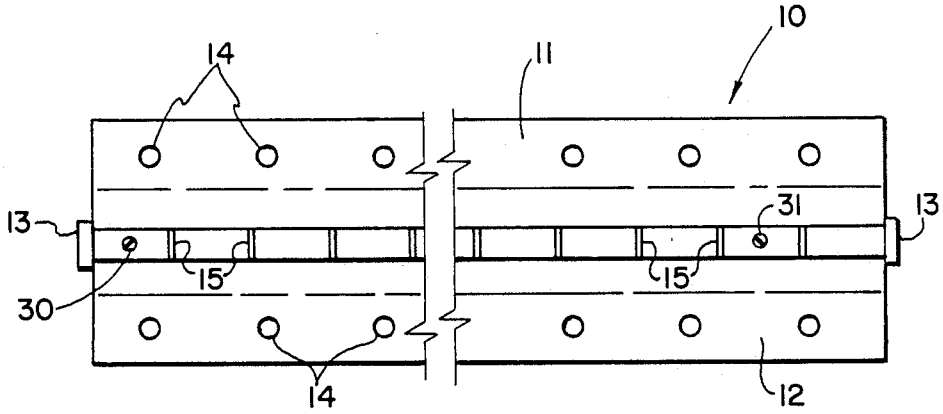
FIG. 1 is a plan view of a continuous elongated hinge which is made in accordance with the invention.
Figure 2:
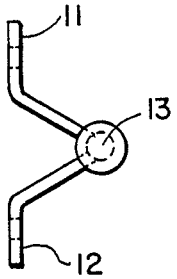
FIG. 2 is an end view of the hinge.
Figure 3:
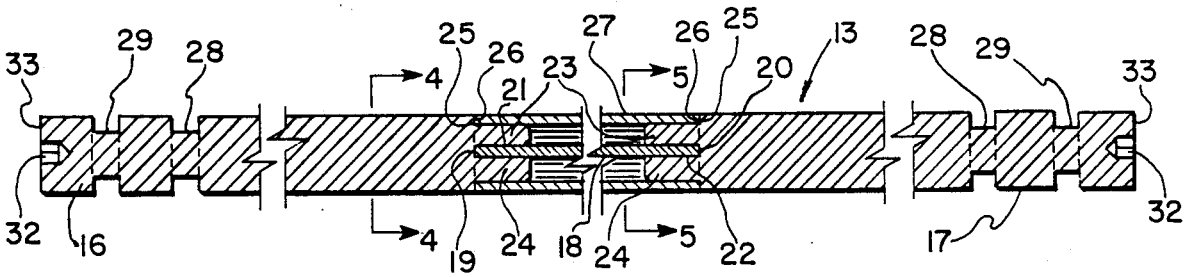
FIG. 3 is a section taken longitudinally of the hinge pin.
Figure 4:
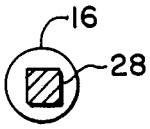
FIG. 4 is a section viewed from the line 4—4 of FIG. 3.
Figure 5:
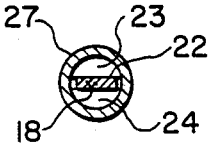
FIG. 5 is a section viewed from the line 5—5 of FIG. 3.

With general reference to the drawing for like parts and particular reference to FIGS. 1 and 2, there is shown a piano-type, continuous, elongated hinge 10 which is comprised of a door leaf 11 which is pivotally mounted on a frame leaf 12 by means of a hinge pin 13. A number of similarly sized aligned screw holes, e.g. hole 14, are provided in the door leaf 11 and frame leaf 12 for receiving screw-type fasteners, not shown, which are used to secure the door leaf 11 to a swinging door and the frame leaf 12 to a door frame in which the door is mounted.

A number of similar, nylon spacers or washers 15 are used to separate the leaves 11, 12 to make the hinge 10 operate more easily.

The hinge pin 13 comprises a pair of axially aligned, similarly-shaped pivot pins or rods 16, 17, which are oppositely disposed and separated by a flat spring 18 that has a pair of opposing ends 19, 20 which are received in a pair of slots 21, 22 that are formed between opposing parti-cylindrical lugs 23, 24, that project from each of the more closely spaced, bifurcated ends of the pivot pins 16, 17.

An annular shoulder 25 is formed at the proximal end 26 of each pair of projecting lugs 23, 24, and act as abutments against which a hollow cylindrical sleeve 27, surrounding the flat spring 18 and lugs 23, 24, rests. The comparatively rigid sleeve 27 has an outer diameter equal to that of the pivot pins and acts to maintain the nylon washers 15 and leaves 11, 12 in properly aligned operating relation.

The flat spring 18 is composed of spring steel or spring stainless steel, and has a rectangular cross-section and torsional strength which is correlated to the size and weight of the door on which the hinge is used.

The pivot pins 16, 17, are similarly composed of any suitable steel or stainless steel and are sufficiently sized to carry the weight of the door on which the hinge is used. Each of the pivot pins 16, 17, are solid and cylindrical, in shape, except for a pair of spaced, square shanks or flats 28, 29, which are provided to receive a pair of set screws 30, 31 by which, for example, the door leaf 11 is secured to the one pivot pin 16 and the frame leaf 12 is fastened to the other pivot pin 17. Thus, it can be appreciated that the flat spring 18 will twist and act as a torsion spring to return a swinging door to a normally closed position when the door is rotated to an open position.

In some cases, it may be better to use a pair of retaining pins in place of the set screws 30, 31, since the retaining pins extend crosswise through the pivot pins 16, 17, to provide a more secure fitting for coupling the parts together.

A hex-shaped hole 32 is provided in the exposed end 33 of each of the pivot pins 16, 17, to receive an allen-type wrench for rotating the pivot pins 16, 17, to preset tension in the flat spring 18.

Thus, there has been described a unique piano-type hinge and hinge pin that has a concealed flat spring that acts as a torsion spring when the door is rotated to an open position. The parts are simple and inexpensive to manufacture and assemble.

What is claimed is:

1. An elongated, continuous piano-type hinge, comprising:

(a) a door leaf and a door frame leaf in meshing, rotating relation;

(b) a pair of elongated, solid pivot pins in axially aligned spaced relation, the two pins engaging the leaves and holding them in meshing, rotating relation, the pins being oppositely disposed and sized to carry the weight of a door to which the door leaf is secured, the pins having more closely spaced ends with slots for receiving opposing ends of a spring;

(c) a single flat spring with a rectangular cross-section disposed longitudinally between the pins in engaged relation with the slots, the spring having a torsional strength which is correlated to the weight of the door to which the door leaf is secured;

(d) a hollow cylindrical sleeve extending between the pins in surrounding relation with the spring, the sleeve having an outer diameter which is substantially the same as the outer diameter of each pin; and (e) means for securing one of the pins to the door leaf for unitary rotation therewith and the other of the pins to the door frame leaf for unitary rotation therewith.

2. The hinge of claim 1, wherein the means (e) includes fasteners of the group of set screws and retainer pins.

3. The hinge of claim 2, wherein the means (e) includes a pair of axially spaced square shanks adjacent the ends of each pin farthest from the spring.

4. The hinge of claim 3, which includes means for presetting tension in the spring.

5. The hinge of claim 3, which includes plastic washers between the leaves to facilitate rotation of the hinge.

* * * * *